US010100460B2

(12) United States Patent
Bisaro et al.

(10) Patent No.: US 10,100,460 B2
(45) Date of Patent: Oct. 16, 2018

(54) METHOD OF OPERATING A HEAT PUMP LAUNDRY DRYER AND HEAT PUMP LAUNDRY DRYER OR HEAT PUMP WASHING MACHINE HAVING DRYING FUNCTION

(71) Applicant: Electrolux Home Products Corporation N.V., Brussels (BE)

(72) Inventors: Michele Bisaro, Spilimbergo (IT); Roberto Ragogna, Malnisio (IT)

(73) Assignee: Electrolux Home Products Corporation N.V., Brussels (BE)

( * ) Notice: Subject to any disclaimer, the term of this patent is extended or adjusted under 35 U.S.C. 154(b) by 612 days.

(21) Appl. No.: 14/443,161

(22) PCT Filed: Nov. 11, 2013

(86) PCT No.: PCT/EP2013/073512
§ 371 (c)(1),
(2) Date: May 15, 2015

(87) PCT Pub. No.: WO2017/076035
PCT Pub. Date: May 22, 2014

(65) Prior Publication Data

US 2015/0322618 A1 Nov. 12, 2015

(30) Foreign Application Priority Data

Nov. 16, 2012 (EP) ..... 12192938

(51) Int. Cl.
*D06F 58/20* (2006.01)
*D06F 58/28* (2006.01)

(52) U.S. Cl.
CPC ..... *D06F 58/206* (2013.01); *D06F 58/28* (2013.01); *D06F 2058/287* (2013.01); *D06F 2058/2864* (2013.01)

(58) Field of Classification Search
CPC .. D06F 58/206; D06F 58/28; D06F 2058/287; D06F 2058/2864
See application file for complete search history.

(56) References Cited

U.S. PATENT DOCUMENTS

2014/0298678 A1* 10/2014 Tezcan ..... D06F 58/206 34/565

FOREIGN PATENT DOCUMENTS

DE 4409607 A1 10/1994
DE 102005041145 A1 3/2007
(Continued)

OTHER PUBLICATIONS

International Search Report dated Jan. 2, 2014 in corresponding International Application No. PCT/EP2013/073512.
(Continued)

*Primary Examiner* — Jessica Yuen
(74) *Attorney, Agent, or Firm* — RatnerPrestia

(57) ABSTRACT

A method is provided for operating a heat pump laundry dryer or a heat pump washing machine having drying function. The laundry dryer or washing machine includes: a control unit controlling the operation of the laundry dryer or washing machine, a laundry treatment chamber for treating laundry using process air, a process air circuit for circulating the process air, a heat pump system having a refrigerant loop, in which the refrigerant fluid is circulated through a first and a second heat exchanger, a compressor for circulating the refrigerant fluid through the refrigerant loop, and a cooling fan unit (24) for cooling the compressor. The method includes: modifying or changing an operation parameter set of the cooling fan unit (24) in dependency of at least one of the following input variables: a user selectable input variable, a working parameter of the laundry drum, a working parameter of a process air fan, a working parameter set meter of an electric driving motor, a working parameter
(Continued)

of the compressor, a drying progress status parameter or a status parameter of the laundry to be dried, and an environment parameter of the treatment apparatus environment.

19 Claims, 4 Drawing Sheets

(56) References Cited

FOREIGN PATENT DOCUMENTS

| | | | |
|---|---|---|---|
| EP | 1884586 | A2 | 2/2008 |
| EP | 2077350 | A1 | 7/2009 |
| EP | 2212463 | A1 | 8/2010 |
| EP | 2224052 | A1 | 9/2010 |
| EP | 2333149 | A1 | 6/2011 |
| EP | 2455526 | A1 | 5/2012 |
| EP | 2460928 | A1 | 6/2012 |
| WO | 2013050262 | A1 | 4/2013 |

OTHER PUBLICATIONS

Extended European Search Report dated May 23, 2015 in corresponding European Application No. 1292938.4.
International Search Report dated Dec. 9, 2013 in related International Application No. PCT/EP2013/073778.
Extended European Search Report dated May 31, 2013 in related European Application No. 12192940.0.

* cited by examiner

METHOD OF OPERATING A HEAT PUMP LAUNDRY DRYER AND HEAT PUMP LAUNDRY DRYER OR HEAT PUMP WASHING MACHINE HAVING DRYING FUNCTION

BACKGROUND

The invention relates to a method of operating a heat pump laundry dryer or washing machine having a cooling fan unit for cooling a compressor of the dryer and to a heat pump laundry dryer or a heat pump washing machine having drying function.

EP 2 212 463 B1 discloses a household appliance for drying laundry. A heat pump unit and means for cooling a component thereof are arranged in a housing of the appliance. The means for cooling comprises a blower or fan which is adapted to convey cooling air from the outside of the appliance to the component. A temperature sensor is disposed in the housing for generating a signal dependent from a temperature within the housing. The temperature sensor may be arranged adjacent to a heat exchanger for condensing a refrigerant, wherein a control unit of the appliance is programmed to operate the blower in response to the signal. According to an embodiment a motor for driving the blower may have a fixed speed, wherein the control unit is adapted to operate the motor intermittently in response to the temperature signal. According to another embodiment a variable-speed motor is provided, wherein the control unit is adapted to operate the motor at varying speeds depending on the temperature signal.

SUMMARY OF SELECTED INVENTIVE ASPECTS

It is an object of the invention to provide a heat pump laundry dryer or washing machine having drying function and a method of operating a heat pump laundry dryer or washing machine which provide an improved drying performance.

According to an aspect of the invention, a method of operating a laundry treatment apparatus is provided, wherein the treatment apparatus may be a heat pump laundry dryer or a heat pump washing machine having drying function. The treatment apparatus comprises: a control unit controlling the operation of the laundry dryer or washing machine, a laundry treatment chamber (e.g. laundry drum) for treating laundry using process air and a process air circuit for circulating the process air. A heat pump system having a refrigerant loop is provided in which the refrigerant fluid is circulated through a first heat exchanger (evaporator) and a second heat exchanger (condenser) by means of a compressor. For example the compressor may have a fixed rotational speed or may be a variable speed compressor. The treatment apparatus further comprises a cooling fan unit or blower unit for cooling the compressor. The cooling fan unit comprises for example at least one fan and a motor for driving the at least one fan. The cooling fan unit is adapted to cool the compressor during a drying operation, i.e. to remove excess heat from the heat pump system, to provide that the energy-efficient steady state or targeted operation state of the heat pump system is maintained during a drying operation (after a warm-up period at the beginning of a drying cycle).

The method of operating a heat pump laundry dryer or a heat pump washing machine having drying function as described above comprises: modifying or changing an operation parameter set of the cooling fan unit in dependency of at least one of the following input variables: a user selectable input variable, a working parameter of the laundry drum, a working parameter of a process air fan, a working parameter of an electric driving motor, a working parameter of the compressor, a drying progress status parameter or a status parameter of the laundry to be dried, and an environment parameter of the treatment apparatus environment. Thus the operation parameter settings of the fan unit may be adapted to a plurality of different input variables (e.g. input variable signal levels or signal states). I.e. the cooling power of the fan unit is adjustable to requirements of each specific drying cycle, such that the heat pump system operates at all times at best possible conditions. I.e. it is provided that as soon as the heat pump system operates in a steady state, this ideal operation state is maintained, whereby the drying performance of the treatment apparatus is improved, in particular with respect to energy-efficiency.

For example an operation parameter set of the cooling fan unit may comprise one or more of the following operation parameters, in particular an arbitrary combination thereof: a fan rotation speed, i.e. a fan flow rate, an On/Off activation power duty ratio, e.g. controlled by driving a cooling fan motor through a PWM (pulse-width modulation) signal to control the fan speed, a threshold temperature above which the cooling fan unit is switched on and below which the fan unit is switched off, and additionally or alternatively an On/Off time profile (e.g. duty ratio of operational ON/OFF periods), e.g. driving the fan not continuously but through a certain activation rhythm (e.g. 20 sec. ON, 5 sec. OFF).

A user selected variable, i.e. a user selection, may be for example a selected cycle, a selected cycle option or drying program type (e.g. fast-drying or night operation (silent and slow mode), a residual laundry humidity, final humidity or drying level (e.g. extra-dry or iron-aid having a higher residual laundry humidity), a laundry amount (input by user, detected by a weight sensor of the treatment apparatus (e.g. laundry dryer), or estimated by an appropriated algorithm, a laundry type (e.g. cotton, wool etc.), an energy-saving option, and a drying process time-saving option (e.g. eco-mode, rapid).

A working parameter of the laundry compartment or laundry drum may be a power consumption of a drum motor for driving the drum or a rotation speed of the drum motor. In particular a plurality of laundry parameters can be derived from the power consumption of the drum motor. For example the laundry amount or load and its humidity or loss of humidity may be concluded/estimated from the detected power consumption of the drum motor. E.g. when driving or rotating the drum with a large (high weight) laundry load, the power consumption for rotating the laundry drum is higher than for a less weighing laundry load. Further, when the humidity level of the laundry decreases during a drying process, the drum motor has a lower power consumption when agitating the (less weighing) laundry.

A working parameter of the process air fan may be a fan rotation speed, a fan motor power consumption or a fan flow rate.

A working parameter of an electric driving motor, for example a drum motor driving a laundry drum, a fan motor for driving process air through the process air circuit, may be the motor power supply, the power consumption as described above, or the current, the voltage, the phase supplied to such motor, or a parameter calculated therefrom, such as the motor torque.

A working parameter of the compressor may be its power consumption, the compressor speed or a compressor motor status (e.g. On/Off).

A drying progress status parameter or a status parameter of the laundry to be dried may be the laundry weight or a (residual) humidity signal of the laundry dried in the laundry compartment. The weight or humidity of the laundry may be detected at a start or beginning of a drying cycle or may be monitored, directly or indirectly in a repeated or continuous manner during a drying cycle, i.e. during the execution of a drying program.

An environment parameter of the environment of the treatment apparatus may be the detected ambient temperature and additionally or alternatively the humidity of ambient air outside the treatment apparatus.

An operation parameter set of the fan unit may be modified or changed in dependency of any one of the above described input variables or in dependency of an arbitrary combination of two or more of the input variables. I.e. the invention may be carried out in dependency of each input variable independently from the other input variables.

According to an embodiment, the method comprises detecting or monitoring at least one of the input variables during the execution of a drying program or drying cycle and executing a predetermined fan unit control profile in dependency of the at least one detected input variable. For example a detected input variable may be a user-selected input variable as described above, which is selected before or while starting a drying program, or may be the status of the laundry or an environment of the treatment apparatus at a start or beginning of a drying cycle or during a drying cycle (e.g. laundry humidity or laundry weight) which is detected by a sensor of the treatment apparatus.

For example an executed fan unit control profile may be a time behavior or time pattern, i.e. a profile over time, which may be applied during the whole (or remainder) of the drying program or only for a predetermined period or during a predetermined sub-sequence of the drying program after detecting or monitoring an input variable. In other words each detected value of an input variable is related to a predetermined fan unit control profile, which is executed during (at least a portion or period of) the drying program. Thus the operation of the fan unit can be adapted to present (cooling) requirements of the compressor, i.e. of the heat pump system, represented by the detected input variable value.

Preferably the predetermined fan unit (time) profile includes one or more of the following: a predetermined fan unit speed or conveyance capacity profile (e.g. an individual speed profile over time), a predetermined fan unit On/Off-time profile (e.g. a predetermined activation profile over time like 20 sec. On/5 sec. Off—either periodic or non-periodic), and a predetermined fan unit on/off duty cycle ratio, i.e. the ratio between On-time and Off-time of the fan unit.

According to an embodiment, the method provides a first operation parameter set and at least a second operation parameter set for operating the fan unit or cooling unit. The first operation parameter set has operation parameters that are different of the operation parameters of the second operation parameter set and, if applicable, are different of the operation parameters of the other operation parameter sets. In other words, the method provides a plurality of operation parameter sets, wherein each operation parameter set is different from the other. The plurality of operation parameter sets are provided by the control unit which controls the operation of the fan unit.

A first operation parameter set is selected—i.e. applied via the control unit to the fan unit—for a first set or range of input variables and a second operation parameter set is selected for a second set or range of input parameter variables, wherein the first set of input variables is different from the second set of input parameter variables. In other words, a range (or plurality) of input variables are related to one specific operation parameter set which is applied to operate the fan unit.

For example a range of the drum motor speed (input variable), e.g. motor speed <2000 rpm, is related to a specific On/Off temperature set (fan unit operation parameter set), defining at which temperature the fan unit is switched-on and switched-off (e.g. 58° C./56° C.). Other ranges of drum motor speed may be related to a different On/Off temperature set for the fan unit. Thus the operation parameters of the fan unit may be individually adapted to the specific state or condition of a presently executed drying cycle. For example the temperature may be detected at any place in the treatment apparatus, e.g. at the heat pump system or laundry drum.

Preferably the control unit receives and processes the at least one input variable and is adapted to modify the operating parameter set of the cooling fan unit in response to the receiving and processing of the input variable. In case of repeatedly receiving of one or more of the input variables, preferably the operating parameter set is changed only in response of a change in the input variable status or level. For example when the input variable changes from one predefined level range to another predefined level range (e.g. using thresholds for the variables).

According to a further embodiment the fan unit operation is controlled by monitoring one or more input variables continuously (permanently or repeatedly) in real-time during a drying cycle, wherein a predetermined control profile is associated to each variable input value. I.e. at least one of the above input variables is detected or monitored continuously while a drying program is executed. Thus the operation parameter of the fan unit can be adapted immediately (i.e. after each detection of the input variable) to a change of state or condition of a presently executed drying program, represented by the detected input variable.

In particular the operation parameter set of the cooling fan unit is modified or changed in response to a change of the detected or monitored input variable. Alternatively in response to the detected or monitored input variable exceeding a predefined threshold (e.g. a maximum laundry humidity threshold value) or exceeding a predefined amount of change of the detected or monitored input variable (e.g. using a gradient threshold). For example the power consumption of the compressor is monitored continuously during a drying cycle, such that when the power consumption exceeds a predetermined threshold value a control profile for the fan unit is activated which increases its cooling power, for example by increasing the fan rotation speed.

Preferably an operation parameter set of the cooling fan unit provides an operation profile for switching the fan on and off over time. As described above, detected input variables may be a working parameter of the treatment apparatus (e.g. drum motor speed, power consumption of the apparatus), a machine alarm or a (humidity) status of the laundry dried in the apparatus. If for example the power consumption of the treatment apparatus (i.e. the input variable) increases during a drying cycle above a predetermined threshold value, an operation profile for the fan unit is selected (i.e. applied) which increases the cooling power of the fan unit. For example by providing an operation profile having longer operating phases between non-operating phases of the fan unit, i.e. by increasing a duty cycle of the fan unit. Preferably the method provides at least two different predetermined operation profiles, wherein each one of the predetermined operation profiles is associated to a predetermined value or a predetermined value range of one or more of the input variables.

At least one of the working parameters and the status parameters may be detected by an associated sensor dedicated to the working parameter or status parameter to be detected, wherein the sensor signal is processed by a sensor unit. Examples for a sensor may be: a weight sensor for detecting a laundry amount or load, a temperature sensor for detecting a temperature of the treatment apparatus, in particular a starting temperature of the heat pump, a humidity sensor for detecting a laundry humidity in the laundry compartment. The sensor unit may be implemented or partially implemented in or by the control unit of the treatment apparatus.

According to an embodiment the control unit is adapted to derive at least one of the above mentioned working parameters and status parameters by monitoring a sensor signal or a component status over time. For example as described above the laundry load or loss of humidity may be derived from the power consumption of the drum motor. Another example is deriving a laundry type by monitoring the progress of process air temperature and/or laundry humidity over time possibly with knowledge of a laundry amount. For example wool absorbs more liquid than synthetic fibers. I.e. when heating process air to remove moisture from a load of woolen articles more water has to be vaporized—in comparison to a load of synthetic fibers—such that the temperature of the process air does not rise as fast.

Preferably the selection or the modification of the operation parameter set is made in dependency of a function in which the input variable is used as a function variable. For example an input variable—which is continuously monitored in real-time—provides an equally continuous modification of the corresponding operation parameter set, such that the operation of the fan unit may be immediately and closely adapted to changes of the presently executed drying process.

According to an embodiment the method further comprises: modifying or changing an operation parameter set of the cooling fan unit in dependency of a first input variable as described above, and additionally modifying or changing an operation parameter set of the cooling fan unit in dependency of a second input variable, wherein the type of the second input variable is different of the type of the first input variable. For example the drum motor speed and the humidity level of the laundry load are the detected first and second variables, both variable values defining by means of the control unit a cooling fan unit operation set comprising an On/Off temperature set (e.g. related to drum motor speed as described above) and additionally a cooling fan rotation speed profile (related to the detected laundry humidity) which is executed when the fan unit is activated in dependency of a detected temperature, e.g. at the condenser exit.

Preferably the second input variable is at least one of the following input variables, which have been described in part above: a user selectable input variable, a machine alarm status parameter (e.g. overheat alarm, electric failure alarm etc.), a working parameter of the laundry drum, a working parameter of a process air fan, a working parameter of an electric driving motor, a working parameter of the compressor, a drying progress status parameter or a status parameter of the laundry to be dried, an environment parameter of the treatment apparatus environment, and a working parameter of the heat pump system. A working parameter of heat pump system is for example a temperature of the refrigerant, in particular the refrigerant temperature at one of the heat exchangers, at the compressor outlet or at the condenser outlet.

For a predefined first range of the first input variable the operation parameter set of the cooling unit may be changed in dependency of the second input variable being in a first predefined range or being above or below a first predefined threshold, wherein for a predefined second range of the first input variable the operation parameter set of the cooling unit may be changed in dependency of the second input variable being in a second predefined range or being above or below a second predefined threshold. A general example comprising first and second threshold values (Threshold 1-2) is depicted in the following Table 1:

TABLE 1

| General example | |
|---|---|
| Input Range | fan unit operation parameter set activated |
| Input < Threshold 1 | fan unit operation parameter set 1 |
| Threshold 1 < Input < Threshold 2 | fan unit operation parameter set 2 |
| Input > Threshold 2 | fan unit operation parameter set 3 |

A specific example or application of the general example is shown in Table 2:

TABLE 2

| Specific example | |
|---|---|
| Drum motor speed (connected to fan unit) | fan unit On/Off temperature |
| Speed < 2000 rpm | 58° C./56° C. |
| 2000 rpm < speed < 2800 rpm | 54° C./53° C. |
| Speed > 2800 rpm | 51° C./50° C. |

As shown in Table 2 the first input variable is the drum motor speed, wherein the second input variable is a temperature of a heat pump system temperature or refrigerant temperature. The applied fan unit On/Off temperature (in column 2) is selected in dependency of the drum motor speed (in column 1)—i.e. the higher the drum motor speed the lower the On/Off switching temperature to respond in time to a faster temperature rise of the compressor at higher drum motor speeds.

Preferably a look-up table, e.g. like shown in the example of Table 2, is implemented in the control unit and the operation parameter set to be selected is retrieved from the look-up table in dependency of the respective value or value range of the input variable.

According to an embodiment a further look-up table may be implemented in the control unit and the second input variable to be selected is retrieved from the further look-up table in dependency of the first input variable, wherein the first and second input variables govern the operation of the fan unit as described above and below. For example the first input variable may be the drum motor speed as shown above, the process air blower speed or the drum rotation speed, wherein the second input variable is a threshold temperature or temperature range of a heat pump system temperature or refrigerant temperature.

According to an embodiment the selection of the operation parameter set or the modification of the operation parameter set may be made in dependency of a function in which the first input variable and the second input variable are used as function variables.

The following exemplary equations [1] and [2] show how a fan unit On/Off temperature may be calculated in dependency of the drum motor speed, wherein during an executed drying cycle the detected temperature, e.g. of the heat pump system, defines whether the fan unit is switched On or Off.

$$\text{Fan unit switch-ON temperature (° C.)} = 80 - \text{Drum Motor speed (rpm)}/100 \quad [1]$$

$$\text{Fan unit switch-OFF temperature (° C.)} = 78 - \text{Drum Motor speed (rpm)}/100 \quad [2]$$

I.e. corresponding to the example shown in Table 2 the drum motor speed is the first input variable and a temperature of e.g. the heat pump system is the second input variable, wherein the operation parameter set (switch-On/switch-Off temperature set) is set in dependency of the first input variable. In contrast to the example shown in Table 2, equations [1] and [2] provide a continuous adjustment of the fan unit switch-On/switch-Off temperature.

TABLE 3

Continuous adjustment of fan unit switch-on/-off temperature in dependency of detected drum motor speed

| drum motor [rpm] | fan unit switch-On temp. [° C.] | fan unit switch-Off temp. [° C.] |
|---|---|---|
| 2000 | 60 | 58 |
| 2100 | 59 | 57 |
| 2200 | 58 | 56 |
| . . . | . . . | . . . |
| 2700 | 53 | 51 |
| 2800 | 52 | 50 |
| 2900 | 51 | 49 |
| 3000 | 50 | 48 |

An extended look-up table may be implemented in the control unit and the operation parameter to be selected may be retrieved from the extended look-up table in dependency of the first input variable and in dependency of the second input variable. Another example for an extended look-up table implemented in the control unit is a table which defines a second variable to be selected in dependency of a first variable and additionally defines an operation parameter set in dependency of the detected first and second input variables, e.g. a combination of Table 2 or 3 and a further look-up table as described above.

According to an embodiment a heat pump laundry dryer or heat pump washing machine having drying function is provided, wherein the laundry dryer or washing machine comprises: a control unit controlling the operation of the laundry dryer or washing machine, a laundry treatment chamber for treating laundry using process air, a process air circuit for circulating the process air, a heat pump system having a refrigerant loop, in which the refrigerant fluid is circulated through a first and a second heat exchanger, a compressor for circulating the refrigerant fluid through the refrigerant loop, and a cooling fan unit for cooling the compressor, wherein the control unit is adapted to control the operation of the laundry dryer or of the washing machine as described above.

Any of the above described features and elements of the method of operating a treatment apparatus may be combined in any arbitrary combination and may be implemented in a heat pump laundry dryer or heat pump washing machine having drying function as described above.

BRIEF DESCRIPTION OF THE DRAWINGS

Reference is made in detail to preferred embodiments of the invention, examples of which are illustrated in the accompanying figures, which show.

DETAILED DESCRIPTION OF EXAMPLE EMBODIMENTS

Figure 1:
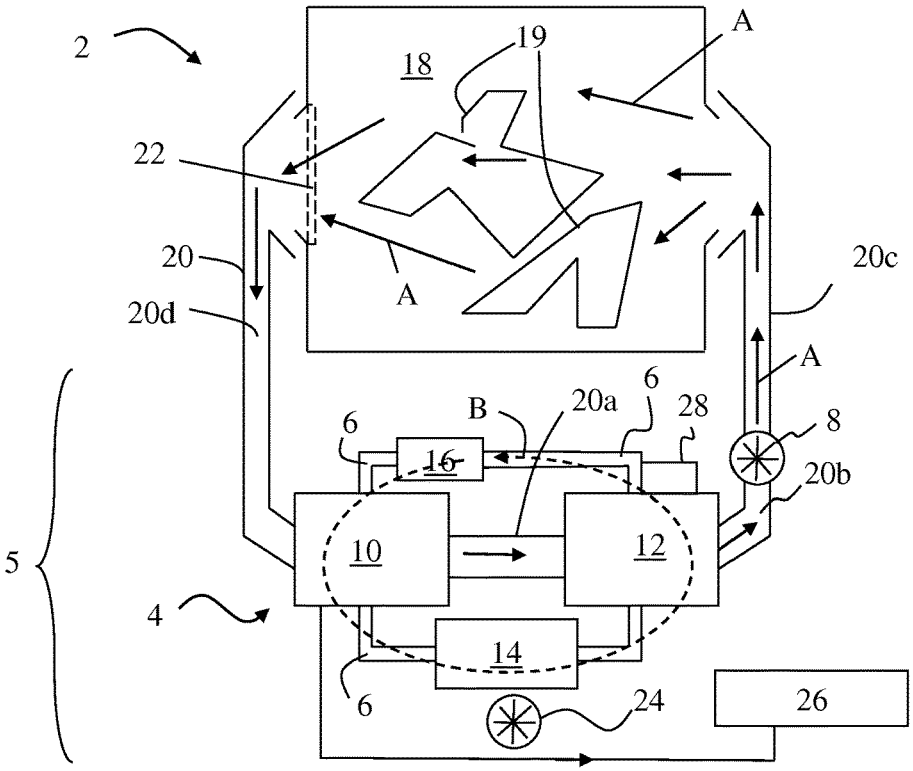
FIG. 1 a schematic view of a laundry treatment apparatus having a heat pump system, FIG. 2 a schematic block diagram of components of the apparatus of FIG. 1, FIG. 3*a-c* schematic block diagrams of different relations between input variables and fan unit operation parameter settings, FIG. 4 a flow chart of how a user selection modifies fan unit parameter settings, FIG. 5 a flow chart showing an example of modifying fan unit parameter settings as given in Table 2, and FIG. 6 a diagram showing the modification of fan unit parameter settings of the example of FIG. 5 in dependency of drum motor speed over time.

FIG. 1 depicts in a schematic representation a laundry treatment apparatus 2 which in this embodiment is a heat pump tumble dryer. The tumble dryer comprises a heat pump system 4, including in a closed refrigerant loop 6 in this order of refrigerant flow B: a first heat exchanger 10 acting as evaporator for evaporating the refrigerant and cooling process air, a compressor 14, a second heat exchanger 12 acting as condenser for cooling the refrigerant and heating the process air, and an expansion device 16 from where the refrigerant is returned to the first heat exchanger 10. Together with the refrigerant pipes connecting the components of the heat pump system 4 in series, the heat pump system 4 forms a refrigerant loop 6 through which the refrigerant is circulated by the compressor 14 as indicated by arrow B. If the refrigerant in the heat pump system 4 is operated in the transcritical or totally supercritical state, the first and second heat exchanger 10, 12 can act as gas heater and gas cooler, respectively.

The expansion device 16 is a controllable valve that operates under the control of a control unit 30 (FIG. 2) to adapt the flow resistance for the refrigerant in dependency of operating states of the heat pump system 4. In an embodiment the expansion device 16 may be a fixed, non-controllable device like a capillary tube.

The process air flow within the treatment apparatus 2 is guided through a compartment 18 of the treatment apparatus 2, i.e. through a compartment 18 for receiving articles to be treated, e.g. a drum 18. The articles to be treated are textiles, laundry 19, clothes, shoes or the like. In the embodiments here these are preferably textiles, laundry or clothes. The process air flow is indicated by arrows A in FIG. 1 and is driven by a process air blower 8 or fan. The process air channel 20 guides the process air flow A outside the drum 18 and includes different sections, including the section forming the battery channel 20*a* in which the first and second heat exchangers 10, 12 are arranged. The process air exiting the second heat exchanger 12 flows into a rear channel 20*b* in which the process air blower 8 is arranged. The air conveyed by blower 8 is guided upward in a rising channel 20*c* to the backside of the drum 18. The air exiting the drum 18 through the drum outlet (which is the loading opening of the drum) is filtered by a fluff filter 22 arranged close to the drum outlet in or at the channel 20.

When the heat pump system 4 is operating, the first heat exchanger 10 transfers heat from process air A to the refrigerant. By cooling the process air to lower temperatures, humidity from the process air condenses at the first heat exchanger 10, is collected there and drained to a condensate collector 26. The process air which is cooled and dehumidified after passing the first heat exchanger 10 passes subsequently through the second heat exchanger 12 where heat is transferred from the refrigerant to the process air. The process air is sucked from exchanger 12 by the blower 8 and is driven into the drum 18 where it heats up the laundry 19 and receives the humidity therefrom. The process air exits the drum 18 and is guided in front channel 20*d* back to the first heat exchanger 10. The main components of the heat pump system 4 are arranged in a base section 5 or basement of the dryer 2.

A cooling fan unit 24 or blower unit is arranged close to the compressor 14 to remove heat from the compressor 14, i.e. from the heat pump system 4, during a drying operation. The cooling air flow, which is an ambient air flow in the embodiments, is actively driven by the cooling fan unit 24 and is taking heat from (the surface of) the compressor 14. The fan unit 24 comprises a blower or fan 36 which is driven by a fan motor 34 controlled by the control unit 30 of the dryer 2. By transferring heat from the compressor 14, during a steady state of operation of the heat pump system 4, thermodynamic balance is achieved between the closed loops of the process air loop and refrigerant loop 6. Thereby the electrical power consumed by the compressor 14 and which is not transformed to work power by compressing the refrigerant, is removed from the heat pump system 4, i.e. heat power of the compressor is balanced in the—under ideal consideration—closed loops of refrigerant and process air. This means, in the steady state of the heat pump system 4 in which maximum or nearly maximum operation condition or efficiency is achieved after the warm-up period, the heat deposited by the compressor 14 in the refrigerant loop 6 is balanced by the cooling fan unit 24 to prevent overheating. After starting the dryer 2 from a cold or ambient state the heat pump system 4 runs through a warm-up phase before reaching the steady state (i.e. normal mode after the warm-up period). As the heat pump system operation status changes (depending mainly on the refrigerant temperature) in the warm-up phase, optimizing cooling requirement over time changes. The present invention provides a solution for optimizing cooling over time.

Figure 2:
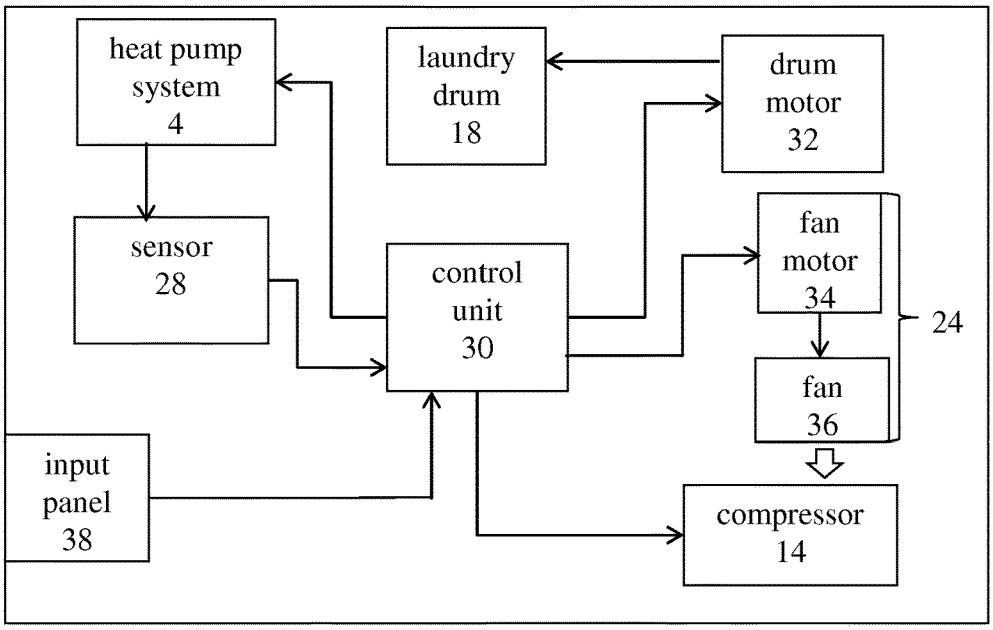

FIG. 2 shows a schematic block diagram of components of the dryer of FIG. 1 illustrating the control of the dryer components. The control unit 30 is adapted to control the operation of the components of the dryer 2, like a drum motor 32, the compressor 14, the valve 16 (optionally) and the fan motor, according to the selected program. Via an input panel 38 a user may select a drying program or cycle, e.g. FAST, ECONOMY, IRON-AID. Optionally further inputs may be made, e.g. residue humidity, laundry amount or laundry type. Further, the control unit 30 is adapted to control the fan unit 24 such that after a warm-up period a steady state of the heat pump system is maintained by operating the fan unit 24 for example as described below.

Figure 3A:
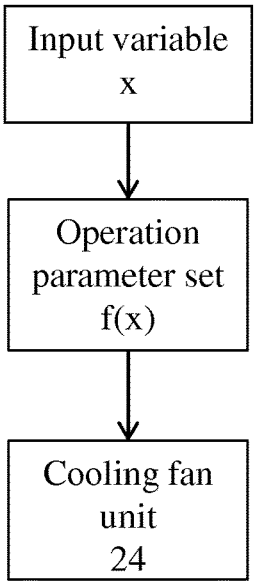

Depending on one or more input variables, which may be for example a user selection (e.g. a selected cycle), a working parameter of the drum motor (e.g. power consumption, motor speed), or a temperature (e.g. detected via temperature sensor 28 at condenser outlet), operation parameter settings of the fan unit 24 may be modified or changed by the control unit 30 as schematically shown in FIG. 3*a*. Operation parameter of the fan unit 24 may be a switch-On/-Off temperature set, a cooling fan rotation speed, an On/Off activation duty ratio, an On/Off time profile (e.g. 10 sec. On, 5 sec. Off).

FIG. 3*a* shows an example for modifying an operation parameter set of the fan unit 24: In a first step an input variable x is detected or monitored by the control unit 30 at the beginning or before starting a drying program or cycle, e.g. the weight of laundry loaded in the drum 18. For example by means of a weight sensor or by a user input via input panel 38 (e.g. low/middle/high load). For each input variable (or range of input variables), i.e. the laundry weight, the control unit 30 is adapted to control the fan unit 24 to execute a predetermined fan unit control profile—e.g. a profile having a predefined On/Off activation profile and/or a predefined fan rotation speed profile. For example a look-up table is implemented in the control unit which relates an input value or a range of input values to a specific fan unit control profile.

Figure 4:
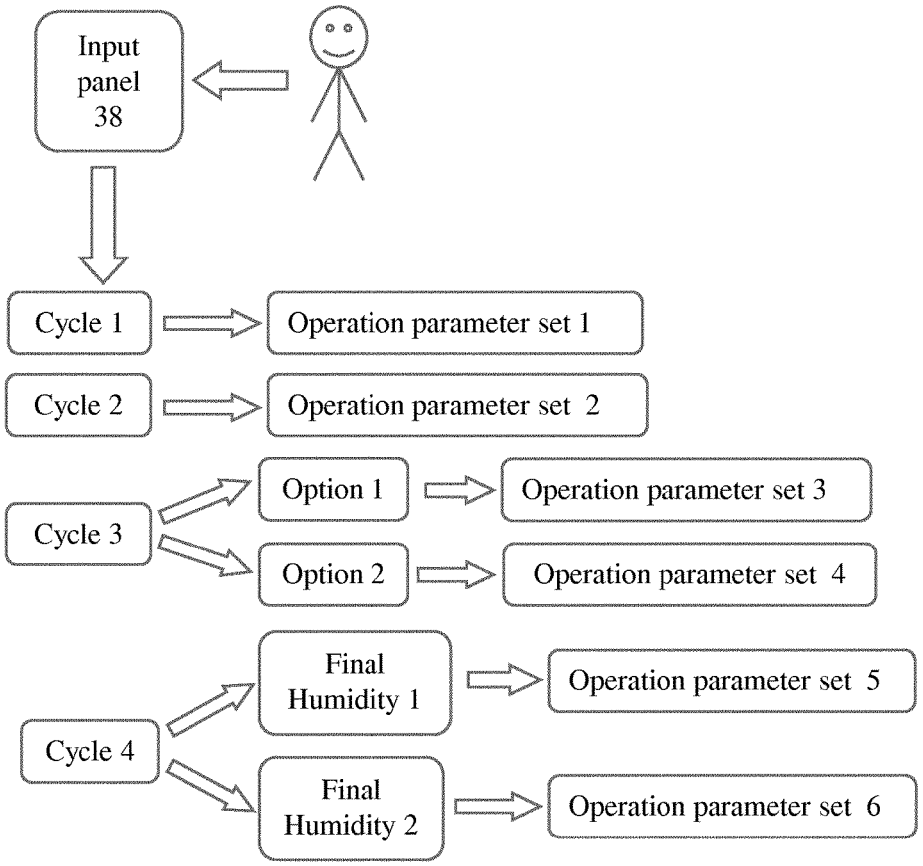

The predetermined control profile may be executed during the (remainder) of the drying program cycle or during a predetermined cycle step (cf. FIG. 4). I.e. the input variable x is detected once (at a start of a drying program) and determines the operation parameter set for the remainder of the drying cycle (or a step thereof). Alternatively the input variable x is detected repeatedly, e.g. permanently in real-time, and the control unit 30 is adapted to calculate an operation parameter set f(x) in dependency of the detected input variable x repeatedly throughout a drying cycle. I.e. the operation of the fan unit 24 may be closely adapted to specific requirements of a presently executed drying program or cycle.

Figure 3C:
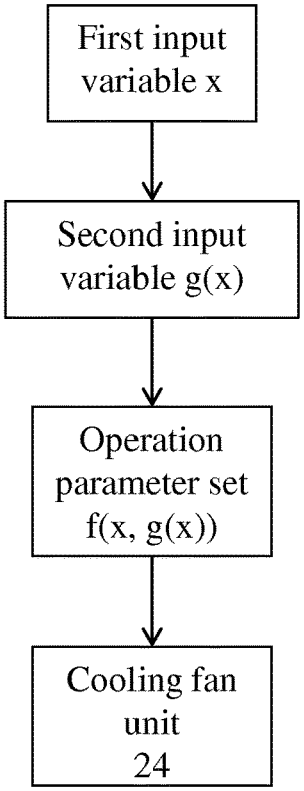
Figure 3B:
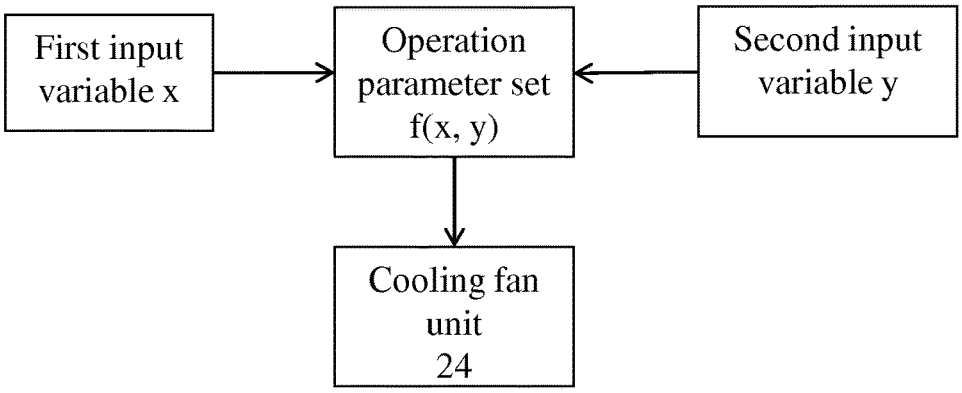

FIG. 3*b* shows another example for modifying an operation parameter set of the fan unit 24: In dependency of a detected or monitored first input variable x and second input variable y the control unit 30 is adapted to determine or calculate a corresponding operation parameter set f (x, y) in dependency of both input variables x, y. The control unit 30 may retrieve the operation parameter set f (x, y) from a look-up table (e.g. Table 2 or 3) or may calculate a corresponding operation parameter set from a predetermined function (e.g. equations [1] and [2]). A look-up table is preferred when relating a plurality of input values (or ranges thereof) to one specific operation parameter set as shown in Table 2. Calculating an operation parameter set is preferred when at least one input value is detected in real-time.

FIG. 3*c* shows a further example for modifying an operation parameter set of the fan unit 24: In dependency of a first input variable x a second input variable g(x) to be detected is selected. For example a look-up table is implemented in the control unit which defines which second input variable is to be selected in dependency of the first input variable. In a next step the operation parameter set f(x, g(x)) is determined by the control unit 30 in dependency of the first and second input variable. For example by means of a further look-up table implemented in the control unit 30 or by providing a function or equation for calculating an operation parameter set for each detected first and second input value as described above.

FIG. 4 shows an exemplary flow chart of how a user selection modifies fan unit parameter settings. Different fan unit operation parameter sets 1 . . . 6 are selected for each drying cycle 1 . . . 4, each drying cycle plus option 1 . . . 2 (e.g. economy, night) and each drying cycle plus final humidity 1 . . . 2 (e.g. iron aid). For example a user selects drying cycle or program number 4 and selects additionally final humidity number 2, e.g. a high final humidity (iron-aid). Then the control unit 30 is adapted to select cooling fan parameter set 6 and correspondingly controls the fan unit 24.

Figure 6:
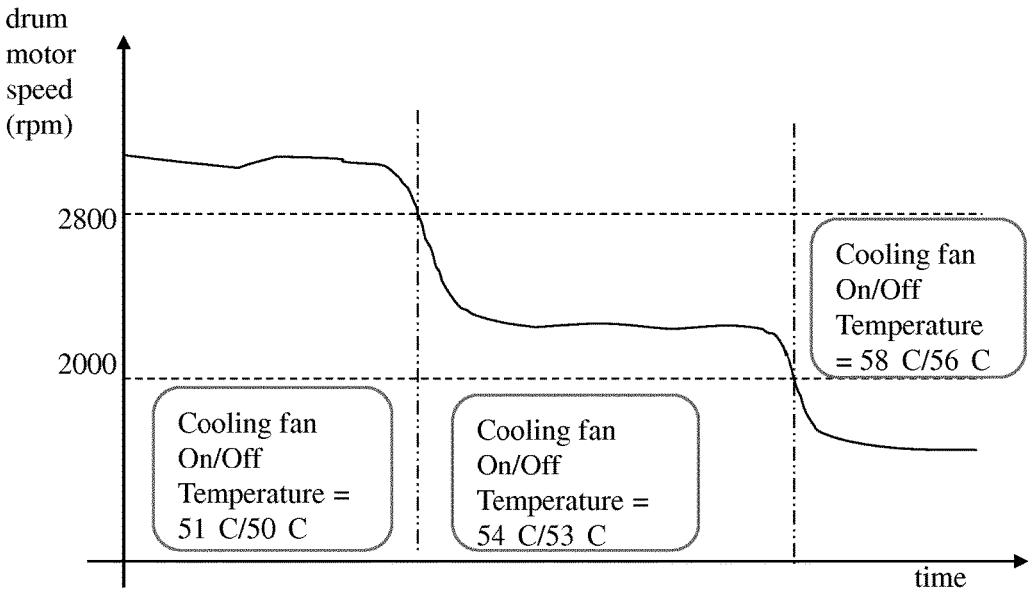
Figure 5:
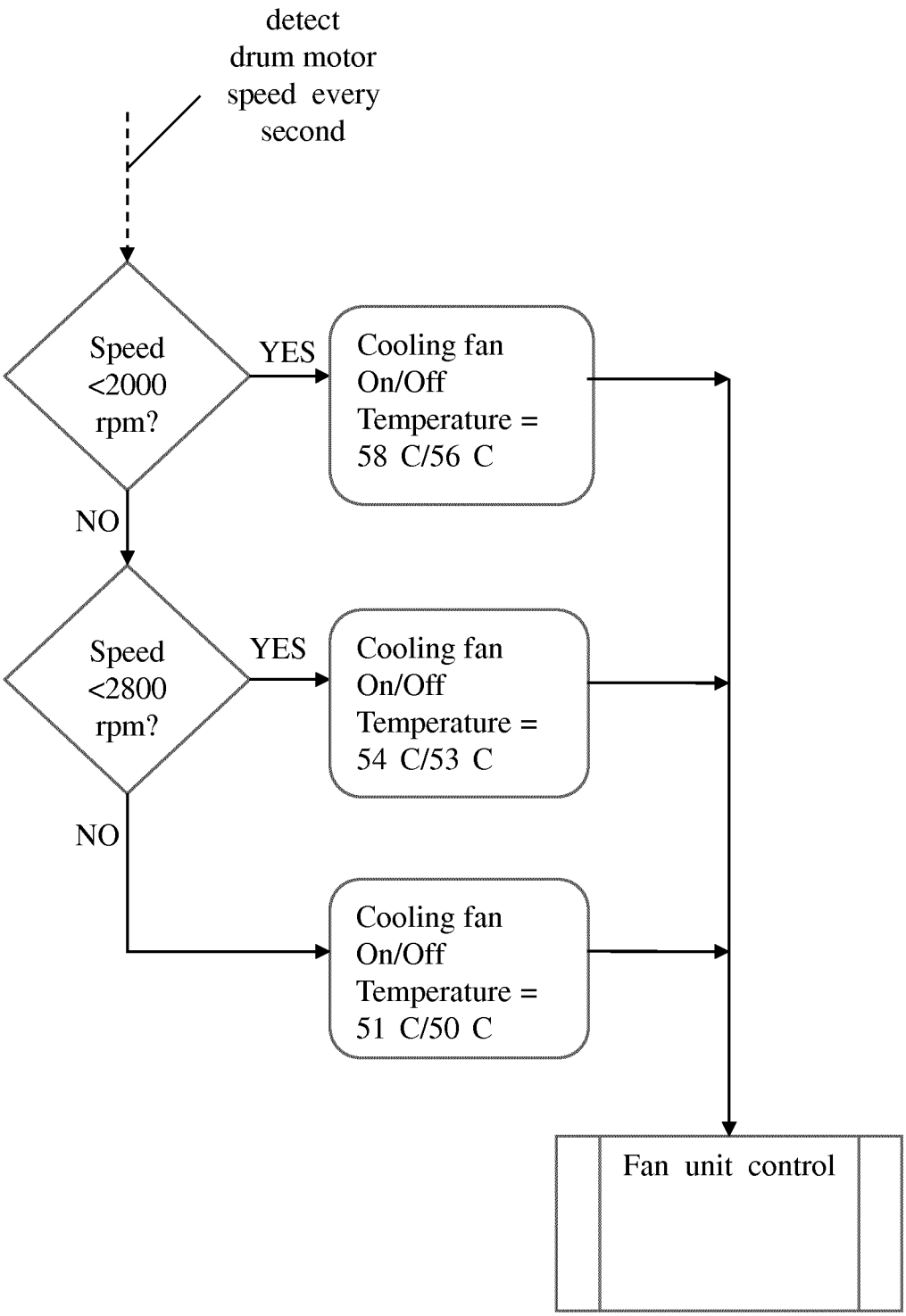

FIG. 5 shows a flow chart of modifying fan unit operation parameter settings as described above in the example of Table 2. I.e. the look-up table as shown in Table 2 is implemented in the control unit 30 to determine operation parameter settings in dependency of two input variables. The first input variable is the drum motor speed and the second input variable is the temperature at the condenser exit detected by a temperature sensor. In dependency of the value of the drum motor speed, i.e. of a working parameter of the drum motor, a related fan unit On/Off temperature set is selected by the control unit 30. This parameter set defines the temperatures at which the fan unit 24 is switched-on and switched-off, respectively, while the temperature of the refrigerant at the condenser exit is detected or monitored repeatedly, e.g. every second. Thus the operation parameter can be adapted continuously to the requirements of the presently executed drying cycle. FIG. 6 depicts a diagram illustrating the modification of fan unit parameter settings over time in dependency of the drum motor speed shown in the example of Table 2 and FIG. 5, respectively.

REFERENCE NUMERAL LIST

2 heat pump tumble dryer
4 heat pump system
5 base section
6 refrigerant loop
8 blower
10 first heat exchanger (evaporator)
12 second heat exchanger (condenser)
14 compressor
16 expansion device
18 drum (laundry compartment)
19 laundry
20 process air channel
20*a* battery channel
20*b* rear channel
20*c* rising channel
20*d* front channel
22 fluff filter
24 cooling fan unit
26 condensate collector
28 temperature sensor
30 control unit
32 drum motor
34 fan motor
36 fan
38 input panel
A process air flow
B refrigerant flow

The invention claimed is:

1. A method of operating a heat pump laundry dryer or a heat pump washing machine having drying function, the laundry dryer or washing machine comprising:

a control unit controlling the operation of the laundry dryer or washing machine, a laundry drum for treating laundry using process air, a process air circuit for circulating the process air, a heat pump system having a refrigerant loop, in which the refrigerant fluid is circulated through a first and a second heat exchanger, a compressor for circulating the refrigerant fluid through the refrigerant loop, and a cooling fan unit for cooling the compressor, the method comprising modifying or changing an operation parameter set of the cooling fan unit in dependency of at least one of the following input variables:

a user selectable input variable, being one or more of a laundry type, a drying program type, a residual laundry humidity, an energy saving and/or drying process time saving option, a laundry amount, a final laundry humidity, and a drying level, a working parameter of the laundry drum, being a power consumption of a drum motor, a rotation speed of a drum motor, a voltage, current, or phase supplied to a drum motor, a motor torque of a drum motor, or a laundry parameter derived from the power consumption of a drum motor, a working parameter of a process air fan, being a process air fan rotation speed, a process air fan motor power consumption, a process air fan flow rate, or a voltage, current, or phase supplied to a process air fan motor, a drying progress status parameter or a status parameter of the laundry to be dried, and an environment parameter of the treatment apparatus environment, being the humidity of ambient air outside the laundry dryer or the washing machine.

2. A method according to claim 1, wherein the method further comprises, during the execution of a drying program:

detecting or monitoring at least one of the input variables, and executing a predetermined fan unit control profile in dependency of the at least one detected input variable.

3. A method according to claim 2, wherein the predetermined fan unit profile includes one or more of:

a predetermined fan unit speed or conveyance capacity profile, a predetermined fan unit on/off-time profile, and a predetermined fan unit on/off duty cycle ratio.

4. A method according to claim 3, wherein:

the method provides a first operation parameter set and at least a second operation parameter set for operating the cooling unit, the first operation parameter set has operation parameters that are different of the operation parameters of the second operation parameter set and, if applicable, are different of the operation parameters of the other operation parameter sets, the first operation parameter set is selected for a first set or range of input variables and the second operation parameter set is selected for a second set or range of input parameter variables, and the first set or range of input variables is different from the second set or range of input parameter variables.

5. A method according to claim 1, wherein the method further comprises during the execution of a drying program:

detecting or monitoring at least one of the input variables in real-time, permanently or repeatedly, and modifying or changing the operation parameter set of the cooling fan unit in response to a change of the detected or monitored input variable or in response to the detected or monitored input variable exceeding a predefined threshold or exceeding a predefined amount of change of the detected or monitored input variable.

6. A method according to claim 5, wherein an operation parameter set of the cooling fan unit provides an operation profile for switching the fan unit on and off over time.

7. A method according to claim 1, wherein the method provides at least two different predetermined operation profiles, wherein each one of the predetermined operation profiles is associated to a predetermined value or a predetermined value range of one or more of the input variables.

8. A method according to claim 1, wherein said at least one input variable includes the user selectable input variable, which is one or more of:

a laundry type, a drying program type, a residual laundry humidity, an energy saving and/or drying process time saving option, and the laundry amount.

9. A method according to claim 1, wherein at least one of the working parameters and the status parameters is detected by an associated sensor dedicated to the working parameter or status parameter to be detected, and the sensor signal is processed by a sensor unit.

10. A method according to claim 1, wherein the control unit derives at least one of the working parameters and the status parameters by monitoring a sensor signal or a component status over time.

11. A method according to claim 1, wherein a look-up table is implemented in the control unit and the operation parameter set to be selected is retrieved from the look-up table in dependency of the respective value or value range of the input variable.

12. A method according to claim 1, wherein the selection of the operation parameter set or the modification of the operation parameter set is made in dependency of a function in which the input variable is used as a function variable.

13. A method according to claim 1, wherein the method further comprises:

modifying or changing an operation parameter set of the cooling fan unit in dependency of a first input variable, and additionally modifying or changing an operation parameter set of the cooling fan unit in dependency of a second input variable, wherein the type of the second input variable is different than the type of the first input variable.

14. A method according to claim 13, wherein the second input variable is at least one of the following input variables:

a user selectable input variable, a machine alarm status parameter, a working parameter of the laundry drum, a working parameter of a process air fan, a working parameter of an electric driving motor, a working parameter of the compressor, a drying progress status parameter or a status parameter of the laundry to be dried, an environment parameter of the treatment apparatus environment, and a working parameter of the heat pump system.

15. A method according to claim 13, wherein:

for a predefined first range of the first input variable, the operation parameter set of the cooling fan unit is changed in dependency of the second input variable being in a first predefined range or being above or below a first predefined threshold, and for a predefined second range of the first input variable, the operation parameter set of the cooling fan unit is changed in dependency of the second input variable being in a second predefined range or being above or below a second predefined threshold.

16. A method according to claim 13, wherein a further look-up table is implemented in the control unit and the second input variable to be selected is retrieved from the further look-up table in dependency of the first input variable.

17. A method according to claim 13, wherein the selection of the operation parameter set or the modification of the operation parameter set is made in dependency of a function in which the first input variable and the second input variable are used as function variables.

18. A method according to claim 13, wherein an extended look-up table is implemented in the control unit and the operation parameter set to be selected is retrieved from the extended look-up table in dependency of the first input variable and in dependency of the second input variable.

19. A heat pump laundry dryer or heat pump washing machine having drying function, comprising:

a control unit controlling the operation of the laundry dryer or washing machine, a laundry treatment chamber for treating laundry using process air, a process air circuit for circulating the process air, a heat pump system having a refrigerant loop, in which the refrigerant fluid is circulated through a first and a second heat exchanger, a compressor for circulating the refrigerant fluid through the refrigerant loop, and a cooling fan unit for cooling the compressor;

wherein the control unit is adapted to control the operation of the laundry dryer or of the washing machine according to the method of claim 1.

* * * * *